US010512346B2

(12) United States Patent
Liu

(10) Patent No.: US 10,512,346 B2
(45) Date of Patent: Dec. 24, 2019

(54) SUPPORTING BASE OF DRINKING CONTAINER

(71) Applicant: Chang Hsien Liu, Taoyuan (TW)

(72) Inventor: Chang Hsien Liu, Taoyuan (TW)

( * ) Notice: Subject to any disclaimer, the term of this patent is extended or adjusted under 35 U.S.C. 154(b) by 0 days.

(21) Appl. No.: 16/412,586

(22) Filed: May 15, 2019

(65) Prior Publication Data

US 2019/0261794 A1 Aug. 29, 2019

Related U.S. Application Data

(63) Continuation-in-part of application No. 15/434,312, filed on Feb. 16, 2017.

(51) Int. Cl.
*A47G 19/22* (2006.01)
*A47G 19/23* (2006.01)

(52) U.S. Cl.
CPC ..... *A47G 19/2255* (2013.01); *A47G 19/23* (2013.01)

(58) Field of Classification Search
CPC ..... A47G 19/2255; A47G 19/23; B65D 81/36
USPC ..... 215/377
See application file for complete search history.

(56) References Cited

U.S. PATENT DOCUMENTS 2,496,792 A * 2/1950 Hellberg ..... A47J 31/4407 220/212
2,996,208 A * 8/1961 Schroeder ..... A47G 19/2255 215/377
3,089,605 A * 5/1963 Buonauro ..... A47G 19/2255 215/377
2004/0134918 A1* 7/2004 Irwin ..... A47G 19/2255 220/630

* cited by examiner

*Primary Examiner* — Jeffrey R Allen
(74) *Attorney, Agent, or Firm* — Rosenberg, Klein & Lee

(57) ABSTRACT

A supporting base of a drinking container is connectable with a bowl, wherein the bowl has an opening and an outer periphery circumferentially provided with an annular groove adjacent to the bottom side of the bowl. The supporting base includes a connecting portion, whose top and bottom ends are provided with a top portion and a bottom portion respectively. The top portion includes a coupling portion for coupling with the annular groove of the bowl. The bottom portion can be placed flat on a flat surface and has a bottom side concavely provided with an upwardly extending receiving room. The receiving room includes a positioning portion configured to press against and thereby secure in position the rim of the opening of the bowl.

7 Claims, 8 Drawing Sheets

SUPPORTING BASE OF DRINKING CONTAINER

This Application is being filed as a Continuation-in-Part of U.S. patent application Ser. No. 15/434,312, filed 16 Feb. 2017, currently pending.

BACKGROUND OF THE INVENTION

1. Technical Field

The present invention relates to the structure of a drinking container and more particularly to the supporting base of a drinking container.

2. Description of Related Art

Referring to FIG. 7, the structure of a conventional drinking container is composed of a bowl 5A and a supporting base 6. The bowl 5A has an outer periphery provided with an annular groove 51A adjacent to the bottom end of the bowl 5A. The supporting base 6 has a top end provided with an annular flange 61. The annular groove 51A of the bowl 5A is engageable with the annular flange 61 of the supporting base 6 to complete the drinking container. The manufacturing process of this drinking container includes making the bowl 5A and the supporting base 6 separately and then packaging the finished parts in an assembled state as shown in the drawing to save space during transportation. More specifically, apart from putting one bowl 5A and one supporting base 6 together, a plurality of bowls 5B and 5C can be stacked up by coupling the rim of the open end of one bowl with the annular groove of an adjacent bowl. The stacked configuration further reduces the space occupied by, and thus facilitates storage and transportation of, the parts.

However, when the parts are packaged in the stacked configuration, each package contains several bowls but only one supporting base, meaning the supporting bases corresponding to all but one of the bowls in each package must be put into a separate package. As the supporting bases are not structured to be positioned with respect to one another, they can only be placed randomly when packaged. Such a packaging scheme is ineffective in saving space and fails to provide good packaging results.

BRIEF SUMMARY OF THE INVENTION

The primary objective of the present invention is to provide a supporting base of a drinking container, wherein the top end and the bottom end of the supporting base can be engaged respectively with the bottom end of a drinking container and the top end of another drinking container so that the supporting base and the drinking containers engaged therewith are secured in position with respect to one another to facilitate packaging.

To achieve the above objective, the present invention provides a supporting base of a drinking container, wherein the supporting base is connectable with a bowl, and wherein the bowl has an opening and further has an outer periphery circumferentially provided with an annular groove adjacent to the bottom side of the bowl. The supporting base includes a connecting portion, a top portion, and a bottom portion. The top portion is provided at the top end of the connecting portion and is provided with a coupling portion for coupling with the annular groove of the bowl. The bottom portion is provided at the bottom end of the connecting portion and is configured to be placed flat on a flat surface. The bottom portion has a bottom side concavely provided with an upwardly extending receiving room. The receiving room is provided therein with a positioning portion configured to press against and thereby secure in position the rim of the opening of the bowl.

In one embodiment, the coupling portion is a continuous and complete annular structure, and so is the positioning portion.

In one embodiment, the coupling portion includes a plurality of segments arranged at intervals in an annular manner, and so does the positioning portion.

In one embodiment, the top portion has an annular sidewall, and the coupling portion is provided along the inner edge of the top end of the sidewall and extends toward the center of the second receiving room to form a flange.

The positioning portion is a vertical fence, an annular recess is formed on the top of the positioning portion and is faced to the engaging space, a protruding portion is formed on the positioning portion below the annular recess.

In one embodiment, the bottom side of the bottom portion has a periphery formed with a supporting portion. The supporting portion and the positioning portion form an engaging space therebetween. The rim of the opening of the bowl can be inserted into the engaging space so as to press against the protruding portion and thereby be secured into annular recess.

DETAILED DESCRIPTION OF THE INVENTION

Figure 1:
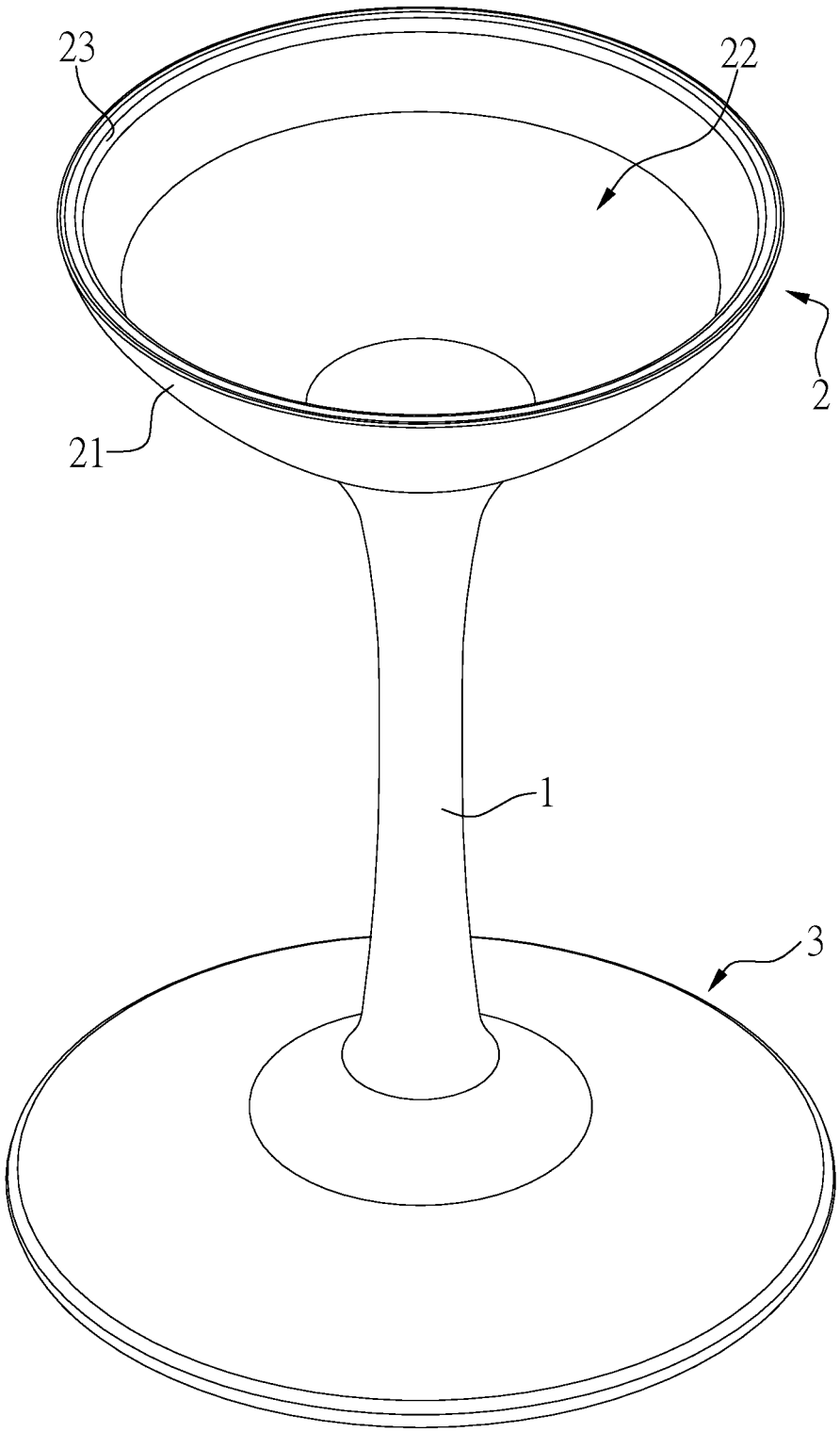
FIG. 1 and FIG. 2 are perspective views of the first embodiment of the present invention.
Figure 2:
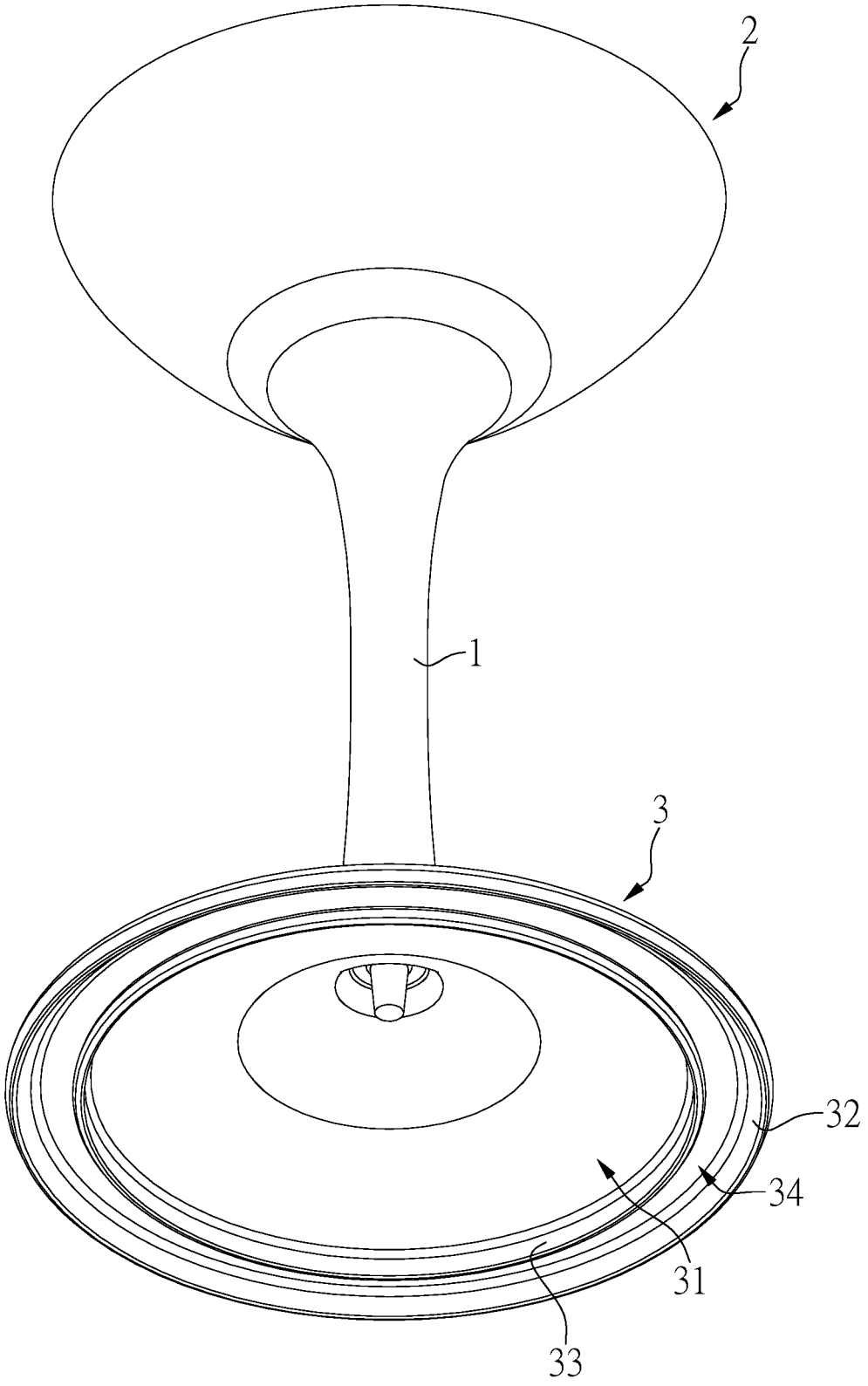
Figure 3:
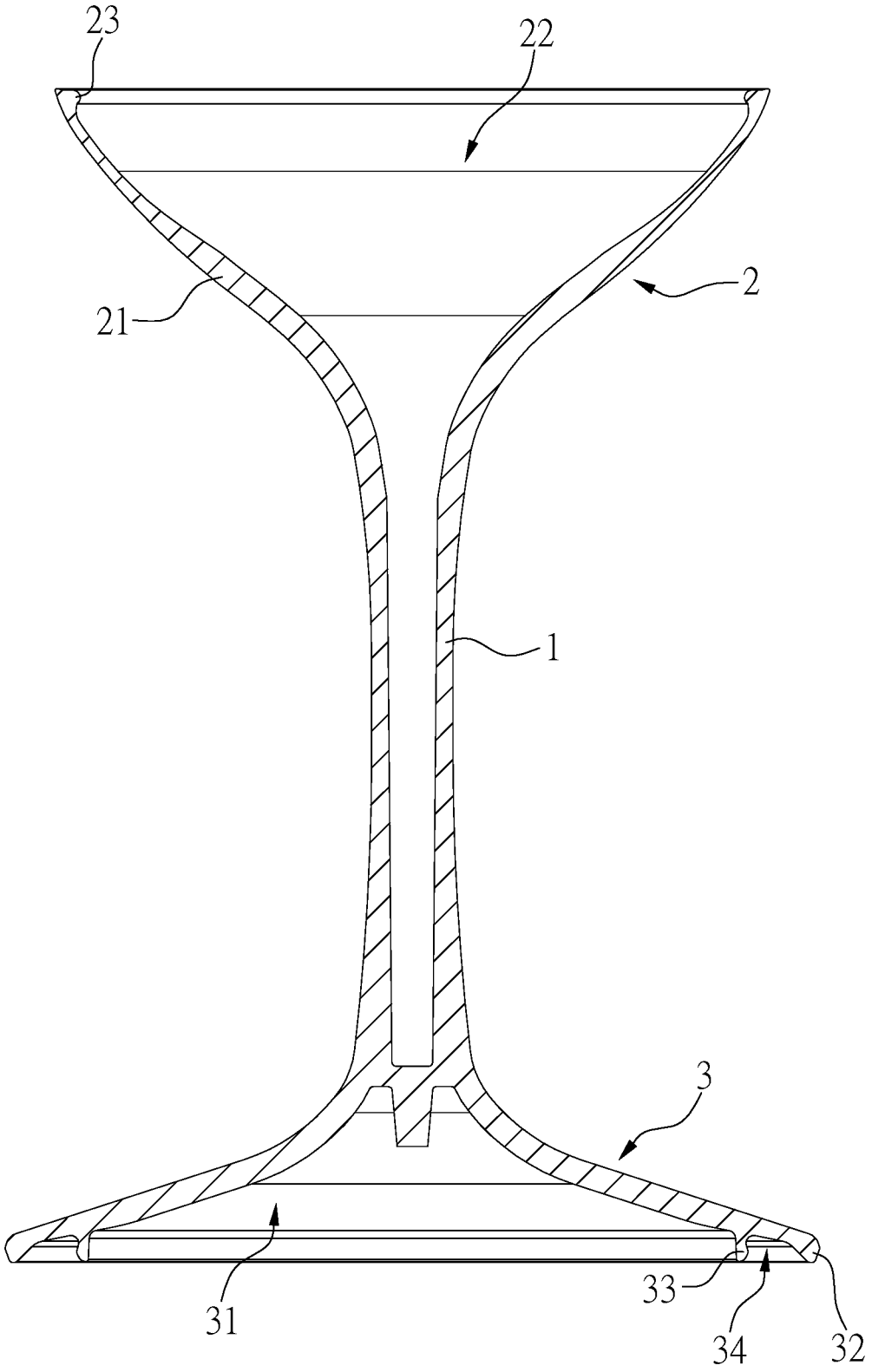
FIG. 3 is a sectional view of the first embodiment of the present invention.

Referring to FIG. 1 to FIG. 3, the present invention provides a supporting base that constitutes part of a drinking container and that is configured to connect with a bowl (not shown), wherein the bowl has an opening and further has an outer periphery circumferentially provided with an annular groove adjacent to the bottom side of the bowl. The supporting base includes a slender connecting portion 1 configured to be held by a user. The connecting portion 1 is provided with a top portion 2 at the top end and a bottom portion 3 at the bottom end.

As shown in FIG. 1 and FIG. 3, the top portion 2 has an annular sidewall 21 that surrounds a second receiving room 22. The top end of the sidewall 21 has an inner edge provided with a coupling portion 23. The coupling portion 23 extends toward the center of the second receiving room 22, thus forming a flange to couple with the annular groove of the bowl. In this embodiment, the coupling portion 23 forms a continuous and complete annular flange along the inner edge of the top end of the sidewall 21.

Figure 3A:
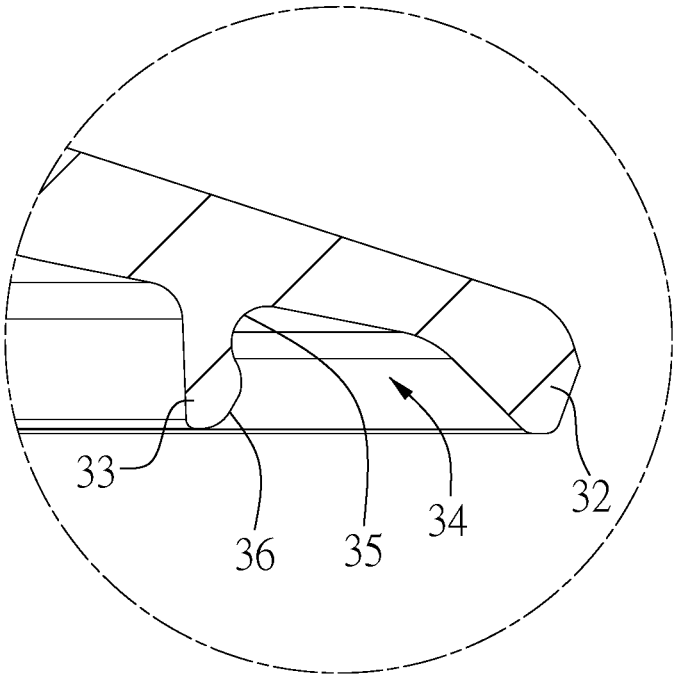
FIG. 3A is a partial enlarged sectional view of FIG. 3.

As shown in FIG. 2, FIG. 3 and FIG. 3A, the bottom portion 3 is flared and is configured to be placed flat on a flat surface. The bottom side of the bottom portion 3 is concavely provided with an upwardly extending first receiving room 31 such that a supporting portion 32 for standing on a flat surface is formed along the periphery of the bottom side. Also, a positioning portion 33 is provided in the first receiving room 31. In this embodiment, the positioning portion 33 forms a continuous and complete annular structure and has a smaller outer diameter than the supporting portion 32. Thus, an engaging space 34 is formed in the first receiving room 31, between the supporting portion 32 and the positioning portion 33. The positioning portion 33 is a vertical fence, an annular recess 35 is formed on the top of the positioning portion 33 and is faced to the engaging space 34, a protruding portion 36 is formed on the positioning portion 33 below the annular recess 35. The rim of the opening of the bowl can extend into the engaging space 34 and press against the protruding portion 36 so as to be secured into the annular recess 35.

Figure 4:
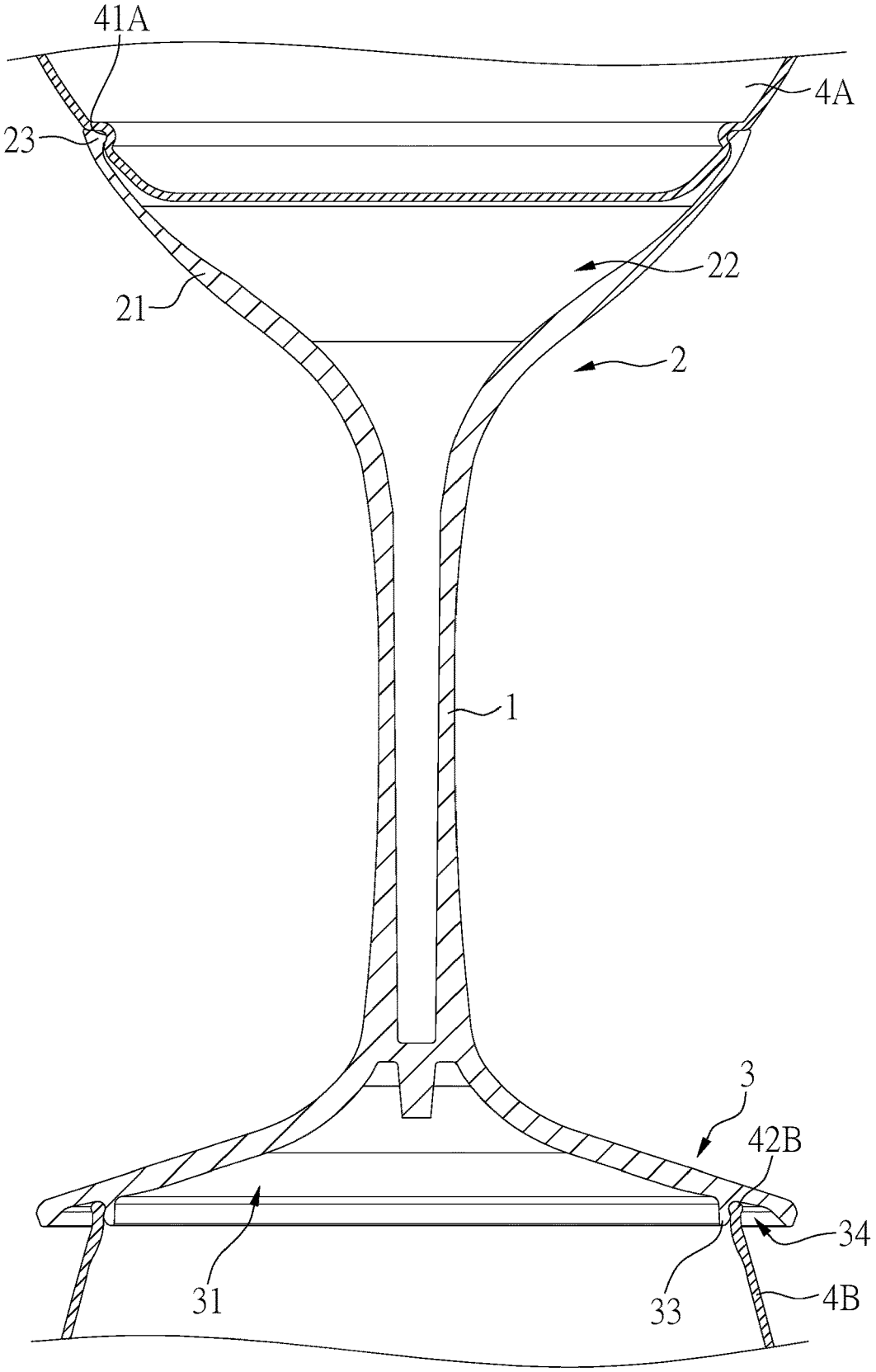
FIG. 4 is a sectional view showing how the first embodiment of the present invention is coupled with a bowl.

Referring to FIG. 4, the foregoing structure is such that once the bottom end of a bowl 4A is inserted into the second receiving room 22 of the top portion 2 of the supporting base, the sidewall 21 holds the bottom end of the bowl 4A in place. Furthermore, the coupling portion 23 of the sidewall 21 is engaged with the annular groove 41A of the bowl 4A to connect the bowl 4A to the top portion 2.

Meanwhile, the rim of the opening 42B at the top end of another bowl 4B can be inserted into the engaging space 34 in the first receiving room 31 of the bottom portion 3 of the supporting base and press against the positioning portion 33 so that, with the positioning portion 33 and the rim of the opening 42B pressing against each other, the bowl 4B and the bottom portion 3 are secured in position with respect to each other.

In summary of the above, the top portion 2 and the bottom portion 3 of the supporting base of the present invention are configured to couple with the bottom end of the bowl 4A and the opening of the bowl 4B respectively, forming a securely positioned series-connected structure that facilitates packaging and transportation of the finished products. The series-connected configuration allows plural supporting bases and plural bowls to be packaged in pairs and saves space effectively.

Figure 5:
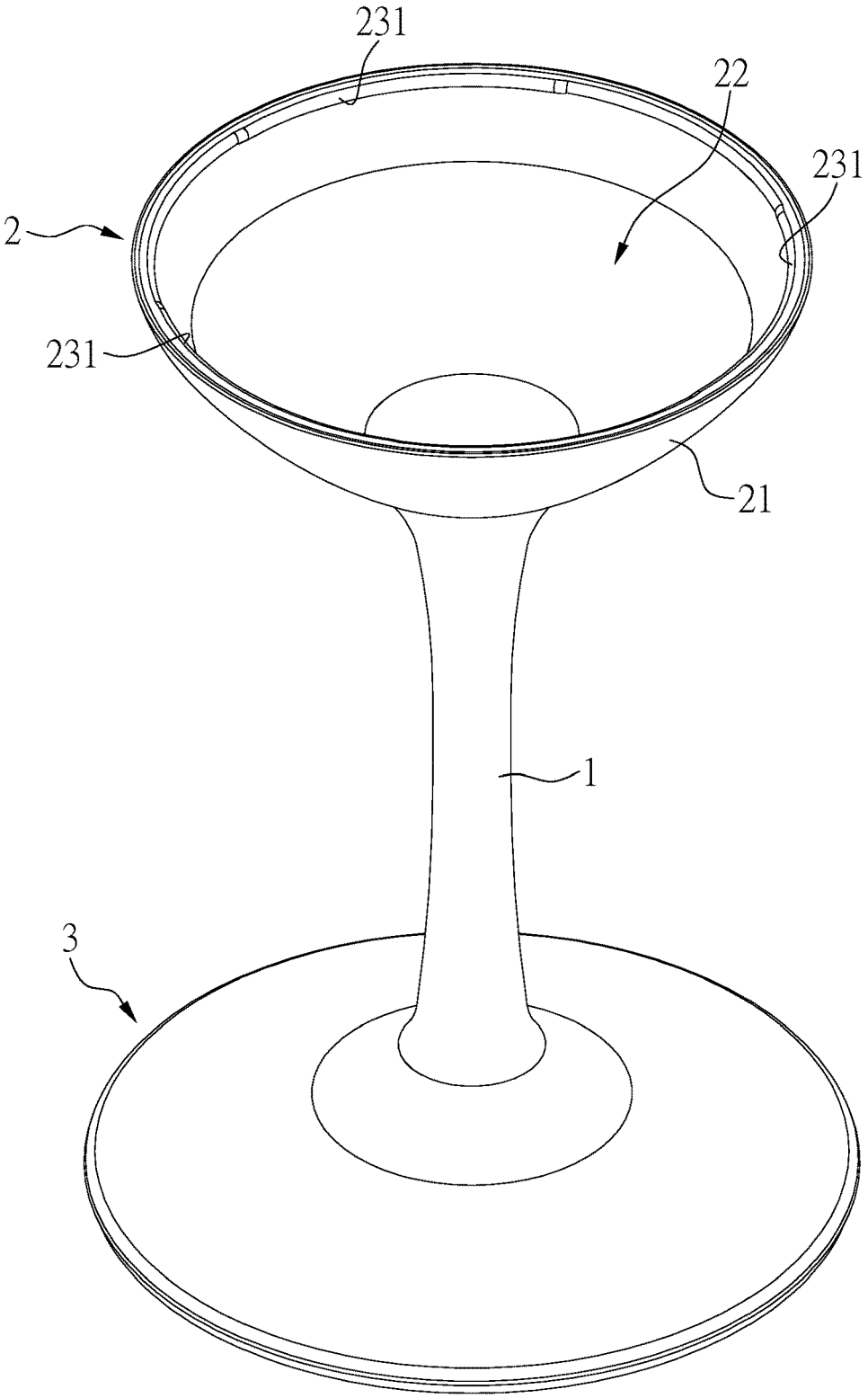
FIG. 5 and FIG. 6 are perspective views of the second embodiment of the present invention.
Figure 6:
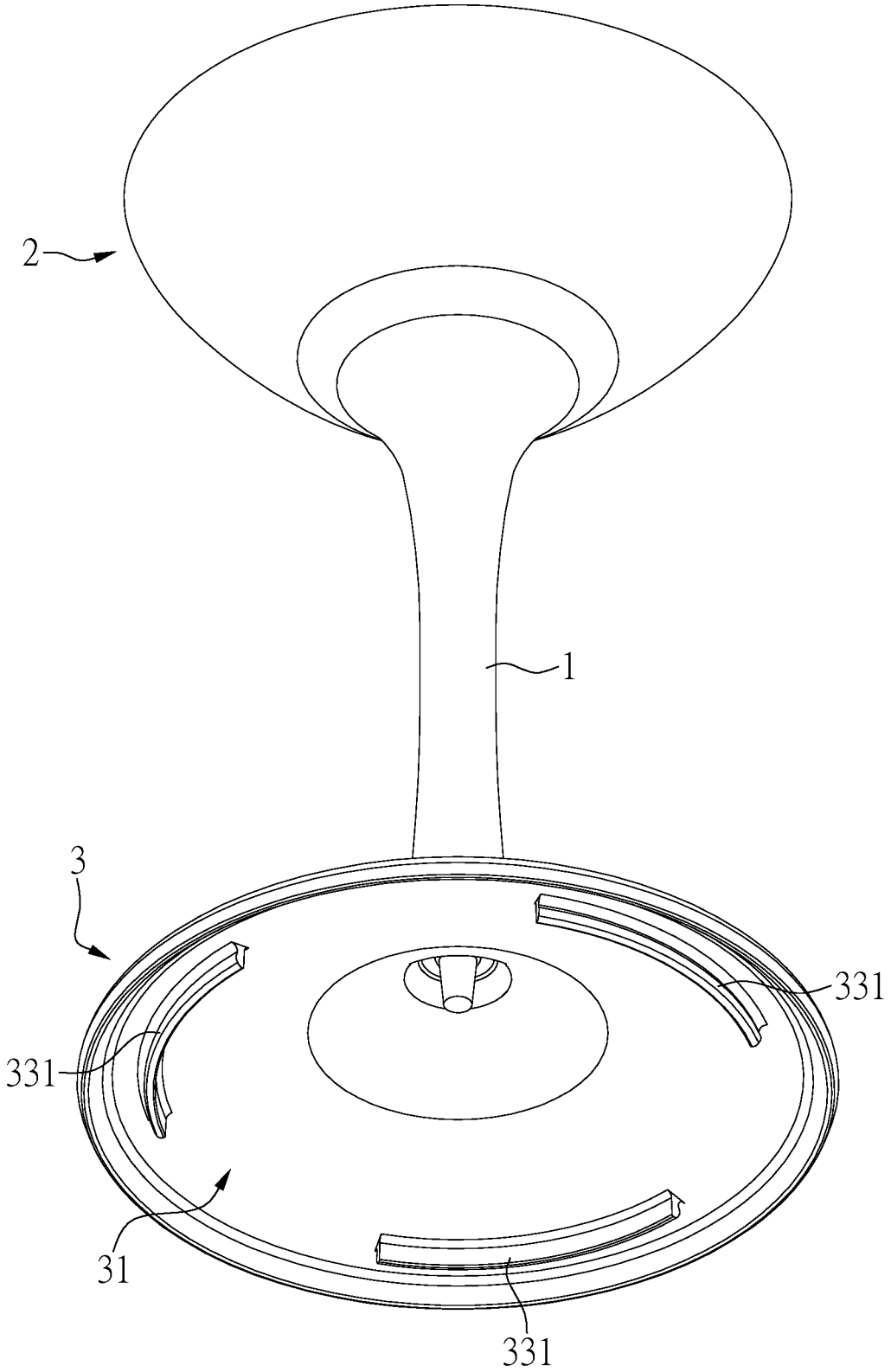
Figure 7:
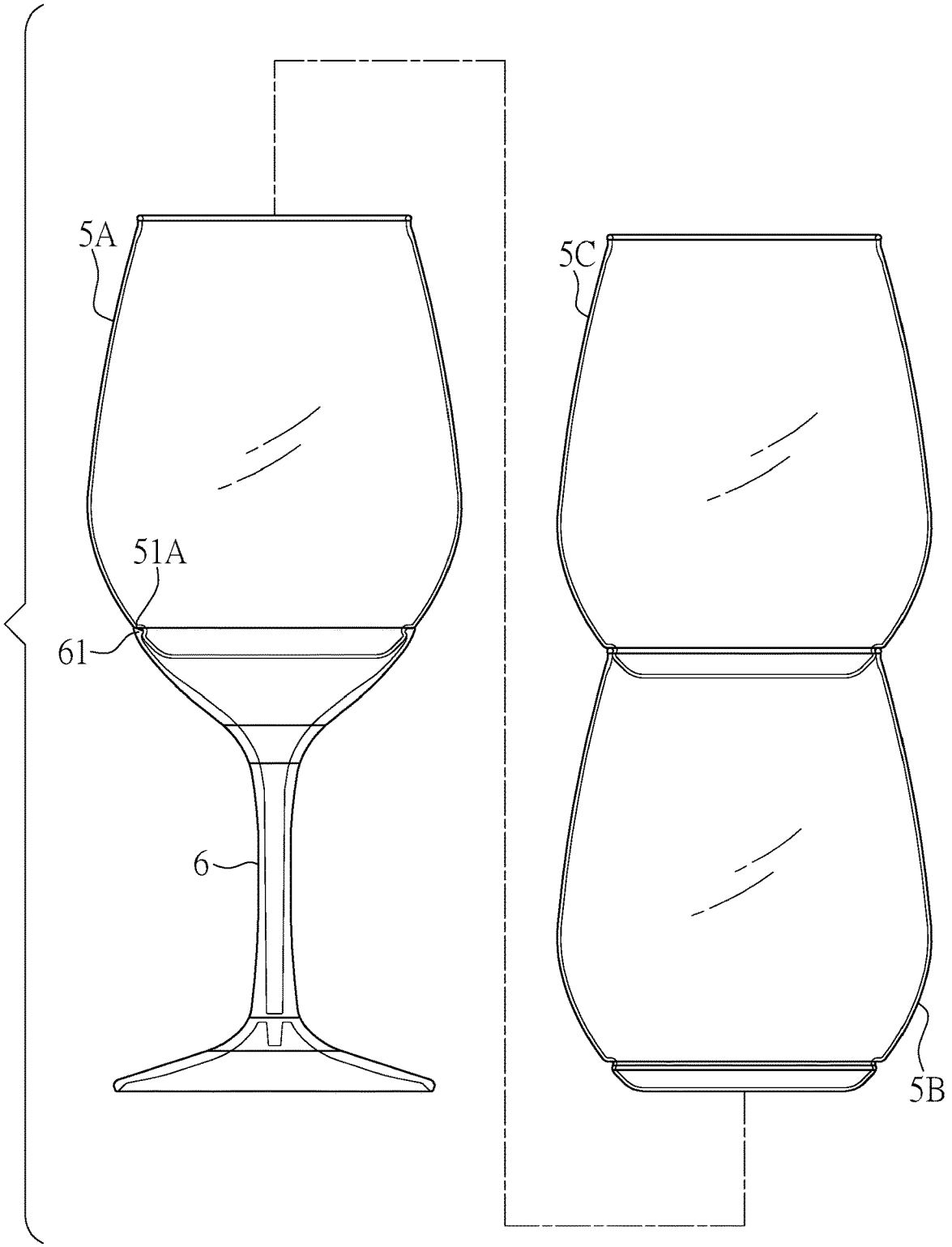
FIG. 7 PRIOR ART
FIG. 7 shows how the supporting base of a conventional drinking container is coupled with a plurality of bowls.

FIG. 5 and FIG. 6 show the second embodiment of the present invention, which is based on the first embodiment and involves modification of the coupling portion and the positioning portion. In the second embodiment, the coupling portion includes a plurality of segments 231 arranged at intervals in an annular manner along the inner edge of the top end of the sidewall 21, and the positioning portion includes a plurality of segments 331 arranged at intervals in an annular manner in the first receiving room 31. The structure of the second embodiment is such that the segments 231 of the coupling portion can be engaged in the annular groove of a bowl to produce a connecting effect, and that the segments 331 of the positioning portion can press against the rim of the opening of another bowl to produce a positioning effect. Thus, the second embodiment works just as well as the first embodiment.

What is claimed is:

1. A supporting base of a drinking container, wherein the supporting base is connectable with a first bowl and a second bowl, each bowl having an opening, and each bowl further having an outer periphery circumferentially provided with an annular groove adjacent to a bottom side thereof, the supporting base comprising:

a connecting portion;

a top portion provided at a top end of the connecting portion, the top portion being provided with a coupling portion for coupling with the annular groove of the first bowl;

a bottom portion provided at a bottom end of the connecting portion and configured to be placed flat on a flat surface, the bottom portion having a bottom side concavely provided with an upwardly extending first receiving room, the first receiving room being provided therein with a positioning portion configured to press radially outward against and thereby secure in position a rim of the opening of the second bowl, the bottom side of the bottom portion forming a supporting portion radially offset from the positioning portion to define an engaging space therebetween for receiving the rim of the opening of the second bowl therein;

the positioning portion being a vertical fence, an annular recess formed on the top of the positioning portion and being faced to the engaging space, a protruding portion formed on the positioning portion below the annular recess; and the bottom side of the bottom portion having a periphery formed with the supporting portion, the supporting portion and the positioning portion form the engaging space therebetween, and the rim of the opening of the second bowl being insertable into the engaging space so as to press against the protruding portion and thereby be secured into the annular recess.

2. The supporting base of claim 1, wherein the coupling portion is a continuous and complete annular structure.

3. The supporting base of claim 2, wherein the top portion has an annular sidewall surrounding a second receiving room, and the coupling portion is provided along an inner edge of a top end of the sidewall and extends toward a center of the second receiving room to form a flange.

4. The supporting base of claim 1, wherein the coupling portion comprises a plurality of segments arranged at intervals in an annular manner.

5. The supporting base of claim 4, wherein the top portion has an annular sidewall surrounding a second receiving room, and the coupling portion is provided along an inner edge of a top end of the sidewall and extends toward a center of the second receiving room to form a flange.

6. The supporting base of claim 1, wherein the positioning portion is a continuous and complete annular structure.

7. The supporting base of claim 1, wherein the positioning portion comprises a plurality of segments arranged at intervals in an annular manner.

* * * * *